US007946199B2

(12) United States Patent
Bradley

(10) Patent No.: US 7,946,199 B2
(45) Date of Patent: May 24, 2011

(54) COAXIAL CABLE CONNECTOR NUT ROTATION AID

(75) Inventor: Edward Joseph Bradley, Livermore, CA (US)

(73) Assignee: The Jumper Shop, LLC, San Diego, CA (US)

( * ) Notice: Subject to any disclaimer, the term of this patent is extended or adjusted under 35 U.S.C. 154(b) by 118 days.

(21) Appl. No.: 12/180,540

(22) Filed: Jul. 27, 2008

(65) Prior Publication Data

US 2010/0022120 A1 Jan. 28, 2010

(51) Int. Cl.
*B25B 13/06* (2006.01)
*H01R 9/05* (2006.01)

(52) U.S. Cl. ..... 81/121.1; 439/578

(58) Field of Classification Search ..... 81/121.1, 81/472; 439/578, 585, 583, 584; D8/14, D8/22, 71

See application file for complete search history.

(56) References Cited

U.S. PATENT DOCUMENTS 3,212,050 A 10/1965 Stark
4,730,385 A * 3/1988 Ryan et al. ..... 29/750
4,854,893 A 8/1989 Morris
5,297,458 A 3/1994 Smith et al.
5,316,348 A 5/1994 Franklin
5,367,925 A 11/1994 Gasparre
5,572,912 A * 11/1996 Gasparre ..... 81/121.1
D398,493 S 9/1998 Jones
5,857,711 A * 1/1999 Comin-DuMong et al. .... 285/38
6,034,325 A 3/2000 Nattel et al.
D460,739 S 7/2002 Fox
D460,740 S 7/2002 Montena
D460,946 S 7/2002 Montena
D460,947 S 7/2002 Montena
6,716,062 B1 4/2004 Palinkas et al.
6,767,247 B2 7/2004 Rodrigues et al.
6,817,272 B2 11/2004 Holland
6,887,102 B1 5/2005 Burris et al.
6,971,912 B2 12/2005 Montena et al.
7,014,501 B2 3/2006 Montena
7,097,500 B2 8/2006 Montena
7,128,603 B2 10/2006 Burris et al.
7,147,509 B1 12/2006 Burris et al.
7,219,582 B2 * 5/2007 Ito ..... 81/125
7,226,300 B2 6/2007 Khemakhem
7,311,555 B1 12/2007 Burris et al.
7,329,149 B2 2/2008 Montena
7,347,129 B1 * 3/2008 Youtsey ..... 81/467
7,364,462 B2 4/2008 Holland
7,413,693 B2 * 8/2008 Goacher, Sr. ..... 264/148
7,452,237 B1 11/2008 Montena (Continued)

*Primary Examiner* — David B Thomas
(74) *Attorney, Agent, or Firm* — ARC IP Law, PC; Joseph J. Mayo

(57) ABSTRACT

An improved coaxial cable connector rotation aid that facilitates rotation of a coaxial cable connector found on the end of a coaxial cable. Embodiments may include a nut with faceted portions or exclude a nut element. Embodiments may coupled with a nut having threads or the tubular element may include threads. Embodiments may include soft metal, plastic or composites to provide additional shielding. Embodiments allow the aid to slide from a first end of a coaxial cable to a second end, non-fixedly engaging the threaded connector nut on either end so that a single instance of one aid may be utilized on both ends of the cable. As the aid is slidingly engaged on the cable, it cannot be removed and swallowed by a small child or pet. Other embodiments allow for a combined textured and nut aid that allows for rotation by using a tool or by manual rotation.

14 Claims, 4 Drawing Sheets

U.S. PATENT DOCUMENTS

| | | | | |
|---|---|---|---|---|
| 7,544,094 | B1 | 6/2009 | Paglia et al. | |
| 2004/0194585 | A1* | 10/2004 | Clark | 81/124.2 |
| 2006/0266166 | A1* | 11/2006 | Weber | 81/184 |
| 2008/0066584 | A1* | 3/2008 | Vines | 81/124.2 |
| 2008/0318469 | A1 | 12/2008 | Paglia et al. | |
| 2009/0163076 | A1 | 6/2009 | Paglia et al. | |

* cited by examiner

COAXIAL CABLE CONNECTOR NUT ROTATION AID

U.S. patent applicant Ser. No. 12/180,543 entitled "CRIMPING TOOL ADAPTER ALIGNMENT AND INSTALLATION OF FOR COAXIAL CABLE CONNECTOR ROTATION AID" filed Jul. 27, 2008 is hereby incorporated herein by reference. U.S. patent applicant Ser. No. 12/180,544 entitled "COAXIAL CABLE DEBRAIDING AND COAXIAL CABLE CONNECTOR SEATING TOOL" filed Jul. 27, 2008 is hereby incorporated herein by reference.

BACKGROUND OF THE INVENTION

1. Field of the Invention

Embodiments of the invention described herein pertain to the field of coaxial cables. More particularly, but not by way of limitation, one or more embodiments of the invention enable a coaxial connector nut rotation aid that improves manual rotation of a threaded nut found on the end of a coaxial cable connector end, i.e., the threaded nut, to securely attach or detach a coaxial connector to/from a coaxial cable port or device without requiring the use of a wrench for example.

2. Description of the Related Art

Coaxial cable is a type of electric cable comprising an inner conductor surrounded by an insulator layer, such as a dielectric insulator, the insulator layer surrounded by a shield, such as a metallic shield or braided shield for example. The shield is surrounded by an insulating jacket, for example, a plastic jacket. The term coaxial derives from the inner conductor and shield occupying the same geometric axis. Coaxial cables are used for transmission of radio frequency signals, among others. The signal preferably exists between the inner conductor and shield, i.e., outer conductor, protecting the signal from external interference.

Coaxial cables are used for, among other things, electronically connecting high frequency electronic components. For example, a coaxial cable may be used to connect a signal source to a destination device. Device with coaxial cable connection ports may sometimes act as both a signal source and destination. Signal source devices may include, for example, an antenna, cable set-top box, DVD player, video camera, high fidelity stereo, computer or a game controller. Signal destination devices may include, for example, a television set, cable modem or computer. As used herein, the term "device" or "device port" may refer to a source or destination device or both, as will be apparent from the context when a distinction is necessary.

Physical size, frequency performance, attenuation, power handling capabilities, flexibility and cost of a coaxial cable are governed by its design, which may vary significantly for different applications. The inner conductor may be solid or stranded. To achieve better high-frequency performance, the inner conductor may be silver-plated or copper-plated iron wire. The insulator surrounding the inner conductor may be solid plastic, a foam plastic, or may be air with spacers supporting the inner wire. The choice of dielectric determines some of the electrical properties of the cable. A common choice is solid polyethylene (PE) insulator. Lower-loss cables may use a polyethylene foam insulator or solid TEFLON® (PTFE). Some coaxial cables use air (or some other gas) as an insulator; others may have spacers to keep the inner conductor from touching the shield.

Cable shield material may also vary. Conventional coaxial cable has braided wire forming the shield. This allows the cable to be flexible, but it also means there are gaps in the shield layer. In this configuration, the inner dimension of the shield may vary slightly because braided wire may not lie flat. Braided wire is often copper, but may also be silver-plated. For better shield performance, some cables have a double-layer shield. The shield may be two braids, or modernly a thin foil shield covered by a wire braid may be used. Some coaxial cables may include additional shield layers.

The coaxial cable insulating jacket may be made from a variety of materials. PVC is common, but some applications may require fire-resistant materials. Outdoor applications may require the insulating jacket to resist ultraviolet light and/or oxidation. For internal chassis connections, the insulating jacket may be optional. Recently, micro-miniature coaxial cables have been used in mobile phones.

Coaxial cables are usually terminated with Radio Frequency (RF) type connectors for attaching the cable to a device. Some RF connectors are gold or rhodium plated, while others use silver, or nickel or tin plating. Mechanically, RF connectors provide a fastening mechanism (thread, bayonet, braces, or push pull are common) and springs to ensure a low Ohmic electric contact between the cable and the connection port on the target device. Threaded connectors, such as Type-F connectors, typically comprise a nut used to draw the connector into a secure attachment to the connection port of the device. Typically, the cable is inserted into the connector, then the nut is rotated until the connector is well seated in the device port, and the nut holds the cable firmly attached even if the device is moved. A firm seating of the connector to the port is required to prevent signal loss, decrease noise and in the case of outdoor applications to prevent water and other corrosives from invading the cable.

While coaxial cable connector nuts may be rotated by hand, using a tightening tool, such as a wrench or pliers, to tighten the nut is preferred to obtain the desired tight seal. Standard coaxial cables require a wrench to be utilized to rotate the threaded end extent, or nut, of the coaxial cable to securely attach the coaxial connector on, or detach off of, a coaxial cable port, for example on a cable set top box or DVD player. Hand tightening is generally not sufficient to insure that a secure, tight connection is achieved between the coaxial connector and the coaxial cable port. The result of an insecure connection is generally increased noise and/or signal loss. It is difficult and potentially dangerous to use a wrench tightening tool in hard to reach areas and or on components very close to near electric sources such as outlets.

Various tools exist to facilitate proper tightening of coaxial cable connector nuts. For example, a tight plastic tube fitting that extends over the nut of the coaxial connector to facilitate hand tightening is known. Known solutions generally provide a torque aid that fixedly engages the nut and requires one torque aid for each coaxial connector.

Other apparatus, such as torque wrenches, are known that overlay the coaxial connector nut, either from the conductor side or port side, thereby trapping a torque wrench, or fixedly attached between the nut and the collar of the coaxial connector, again fixedly attaching the torque wrench to the coaxial connector. Some known solutions require a torque wrench to be removed from the coaxial connector by breaking fins off the outside of the torque wrench. These types of connectors may be dangerous if the small circular wrench itself or fins detached from the wrench are later swallowed by a child or pet, for example.

Yet another apparatus, called a wrench sleeve, is known. Often made of soft rubber or plastic, a wrench sleeve is used on threaded plumbing connectors such as those found on a garden hose. The wrench sleeve slides up to cover the nut of the threaded connector, providing a large surface area to allow a more comfortable and secure grip of nut of when unscrewing the connector. Apparatus such as the torque wrench and wrench sleeve are proximal to and directly attached the each threaded connector.

For at least the limitations described herein, there is a need for an improved coaxial cable nut rotation aid to facilitate attachment and detachment of coaxial cable connector nuts.

BRIEF SUMMARY OF THE INVENTION

One or more embodiments of the invention comprise a coaxial cable connector nut rotation aid that facilitates manual rotation of the nut of a threaded coaxial cable connector. In addition, various embodiments of the coaxial cable connector nut rotation aid of the invention may engage the threaded nut on either end of the coaxial cable by sliding down the cable. In this way, a single nut rotation aid may be used for both ends of the coaxial cable.

One or more embodiments of the invention allow a coaxial cable connector nut rotation aid to non-rotatably and non-fixedly attach to a coaxial cable connector nut so as to facilitate manual or tool based rotation of the nut, and at the same time maintaining the ability to be easily disengaged from the nut, allowing the aid to be moved along the cable to the opposing end, where it may then be coupled to the other coaxial connector nut on the opposite end of the cable.

Embodiments of the invention may be made from any type of soft metal, plastic or composite material soft enough to form grooves imposed by the connector nut, such as non-heat treated aluminum. Through use of a crimping tool, embodiments of the invention may be non-rotatably coupled to a first cable connector nut. In one or more embodiments, coupling the connector aid to a connector nut imparts a set of grooves into the aid itself. In one or more embodiments, the aid may later be detached and slid down the cable to a second connector nut on the opposite end of the cable, where the aid may be coupled onto the connector nut at the other end of the cable. The second coupling imparts a new set of grooves to the inner portion of the aid to provide a fresh non-rotatable coupling of the aid to the second connector nut. Once grooves are set into the aid, the aid may be moved away from the nut by a small amount of horizontal pressure and located on the opposing side of the cable. By slightly rotating the aid, the original grooves are readily found and the aid may be once again non-rotatably coupled to the original nut. This allows for a single instance of the aid to provide rotational assistance both nut connectors, one on either end of a coaxial cable.

In one or more embodiments of the invention, the aid may, when left in place over a connector nut, provide additional shielding at the connection of the cable to the device such as to aid in lowering noise and decreasing signal loss associated with the coaxial cable and threaded connector. Embodiments of the connector nut rotation aid may be made from a variety of materials comprising the material properties to accept grooves on the inner portion of the connector aid, and to provide an acceptable surface for grasping, holding and rotating the connector nut aid by hand, such as a textured surface for example.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1:
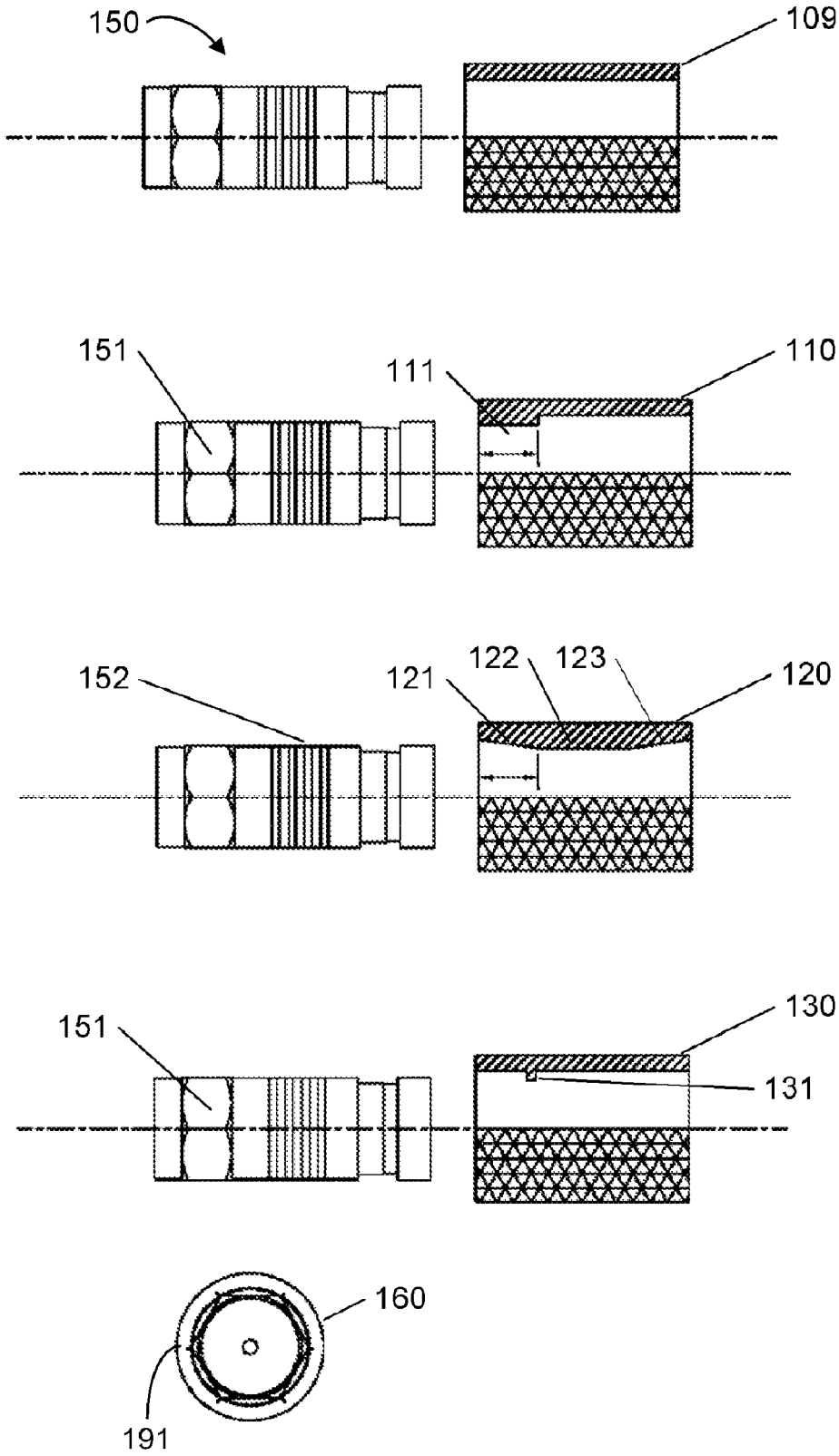
FIG. 1 illustrates four embodiments of a coaxial cable connector nut rotation aid.

A coaxial cable rotation aid will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers will note that although various exemplary embodiments of the invention are set forth herein, the claims, and the full scope of any equivalents, are what define the metes and bounds of the invention.

An RF connector is an electrical connector designed to connect devices communicating at signal frequencies in the multi-megahertz range. Coaxial cables are generally terminated with RF connectors because RF connectors are designed to maintain the shielding that the coaxial cable design offers. Better RF connectors minimize the change in transmission line impedance at the connection. Mechanically, these connectors provide a fastening mechanism (thread, bayonet, braces, or push pull) and springs for a low Ohmic electric contact between the cable and the connection port on the target device.

All types of RF connectors may be used with the coaxial cable connector nut rotation aid of the invention, including for example, standard RF connectors, flange-type RF connectors, precision RF connectors and quick-lock-type RF connectors. Standard RF connectors include, for example, the well-known threaded F-type connectors, N-Hane, N-Hona, R-SMA, R-TNC, SMA-Hane. SMA-Hona, and R-SMA Jack connector types, as well as 7/16 DIN connectors; BNC (Bayonet Neill-Concelman) connectors; C connectors; Dezifix connectors; General Radio (GR) connectors; HN connectors; IEC 169-2 connectors; (standardized in EN 60169-2); LC connectors; Motorola connectors; Musa connectors; NMO mount connectors; N connectors; SC connectors; TNC connectors; and UHF connectors, or other standard types of RF connectors. Flange type RF connectors including the EIA RF Connectors series is an example of a flange type connector. Quick-lock type RF connectors may include: QMA and QN connectors; QLS connectors; SnapN connectors; CQMA, Mini-CQMA and CQN. An APC-7 is a precision type of RF connector or any other quick-lock connector.

The coaxial cable connector nut rotation aid of the invention may also be usable with miniature RF connectors such as the following may be usable including: RG-6, RG-11, RG-58, RG-58c, RG-59, Miniature BNC connectors; Miniature UHF connectors; DIN 47223 connectors; U.FL connector; and SMZ—System 43 (BT43 and High Density HD43) for use in DDF, or any other type of miniature RF connectors. It is possible that one or more embodiments of the invention may also be usable with sub-miniature RF connectors such as: MMCX connectors; MCX connectors; FME connectors; SMA connector, including variants: 3.5 and 2.92 mm connectors, which cross-mate with SMA, and 2.4, 1.85 and 1.0 mm connectors, which do not cross-mate with SMA; SMB connectors; SMC connectors; and SMP connectors or other types of micro-mini RF connectors. In addition, coaxial cables may be terminated with the following connectors: antenna socket; MHV connector for high voltages; and SHV connector, a safer connector for high voltages, all of which may be usable with the coaxial cable connector nut rotation aid of the invention.

FIG. 1 illustrates four embodiments of a coaxial cable connector nut rotation aid. Aid 109 is a hollow cylinder with an internal diameter dimension large enough to accommodate an "F type" threaded coaxial cable connector. In one exemplary embodiment, aid 109 has an inner diameter dimension of about 12.45 mm. Aid 109 is preferable constructed from a soft metal, though other materials discussed herein are also contemplated by the invention. Because of its malleable nature, aid 109, may be coupled onto coaxial cable connector 150 with minimal effort. Aid 110 may also include a narrower inner portion 111 to provide a tighter fit against nut 151, for example. Aid 120 may also provide ramp 121, preferably about 6.5 mm deep into aid 120, wherein innermost area 122 is large enough to accommodate collar 152, while opposing side ramp 123 allows for non-rotatable coupling of aid 120 with a second coaxial cable connector on the opposing side of the cable. Aid 130 comprises stop 131 to provide a limit to the depth at which nut 151 can be displaced into aid 130. Grooves 191 are shown on end view 160 as created by nut 151 when aid 109, 110, 120 or 130 are moved over nut 151. The resulting grooves 191 (6 for a 6 sided nut) result in a non-fixed coupling wherein the aid can be removed with a small force in the rearward direction. Grooves 191 provide for a non-rotatable engagement with respect to the nut, which in turn is then rotatable with respect to collar 152 and the coaxial cable to which the coaxial cable connector is coupled.

Figure 2:
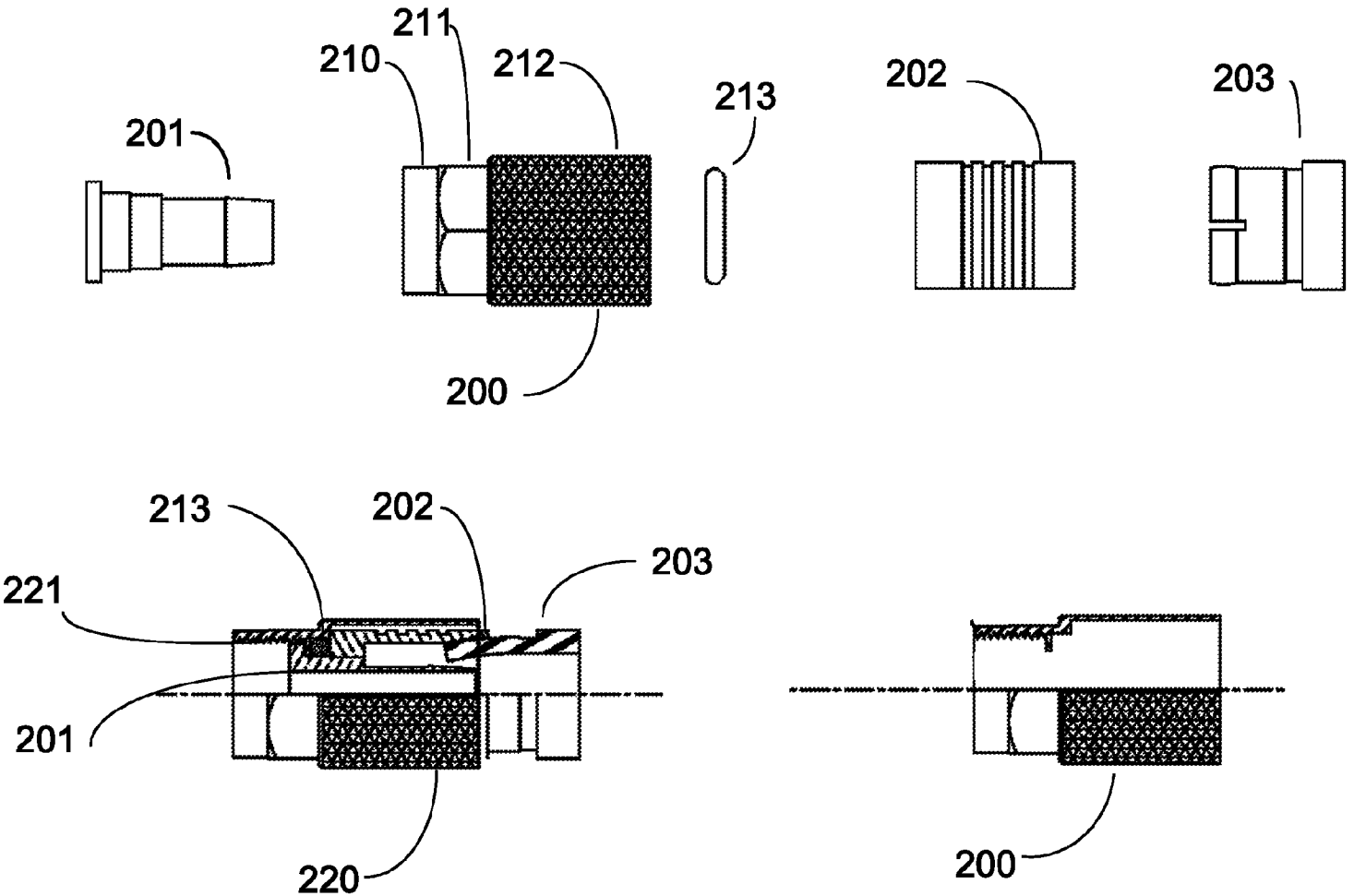
FIG. 2 illustrates one or more embodiments of a coaxial cable connector nut rotation aid that also provides a combined textured and nut aid to facilitate both manual and tool-assisted rotation.

FIG. 2 shows an embodiment of the coaxial cable connector nut rotation aid that also provides a combined textured and nut aid to allow for either wrench or manual tightening/loosening. Combined aid 200 is shown having cylinder extension 210, nut 211, textured area 212 for use as a manual rotation aid for rotating threads 221 onto a coaxial port. Half cutaway view 220 shows post 201, o-ring 213, collar 202 (as known as a body), sleeve 203 (shown individually above view 220). Combined aid 200 is rotatably mounted with respect to post 201, collar 202 and sleeve 203 which couple directly with the coaxial cable that is to be mounted therein. Rotation of combined aid 200 with a wrench via nut 211 or via textured area 212 allows for tightening/loosening of the coaxial connector to a coaxial port.

Figure 3:
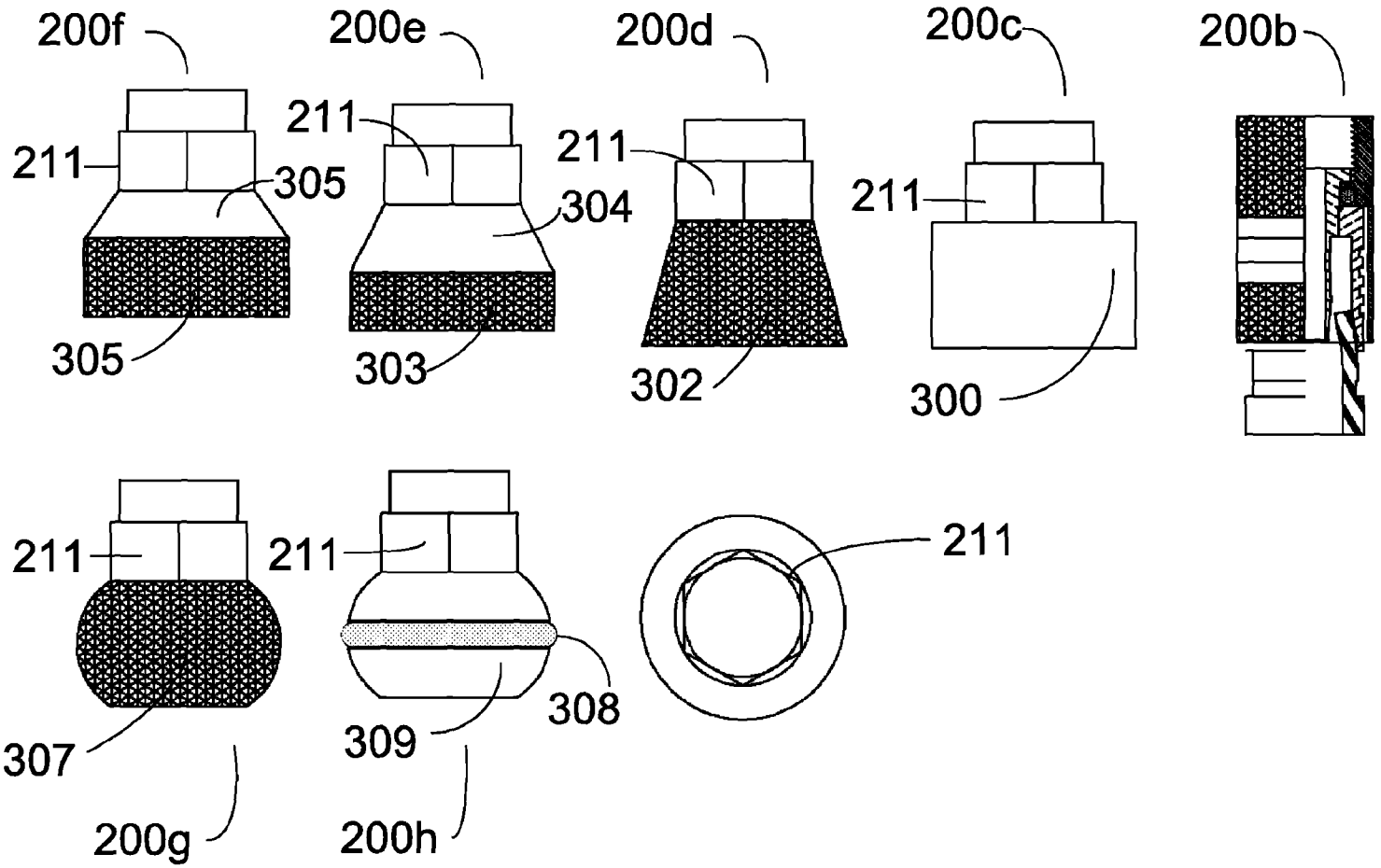
FIG. 3 shows various embodiments of a coaxial cable connector nut rotation aid.

FIG. 3 shows several embodiments of the coaxial cable connector nut rotation aid. Aid 200*b* is an embodiment of combined aid 200 without the nut, i.e., a fixed coupled aid that eliminates the faceted portions of nut 211 from the aid. The remaining embodiments provide for wrench operation via nut 211 or via a textured/smooth area for manual operation as indicated as follows. Embodiment 200*c* provides a smooth surface 300 for manual operation. Embodiment 200*d* provides a conical textured area 302. Embodiments 200*e* and 200*f* provide varying sized textured areas 303 and 305 respectively connected to nut 211 via a smooth area (304 and 305 respectively). Embodiment 200*g* provides for a rounded textured area 307. Embodiment 200*h* provides a rubber strip 308 along the circumference of a rounded smooth area 309.

As embodiments may be constructed from a soft metal or other high frequency shields and/or materials hard enough to create grooves, these embodiments provide a level of shielding not found in non-shielded plastic versions thereof.

Figure 4:
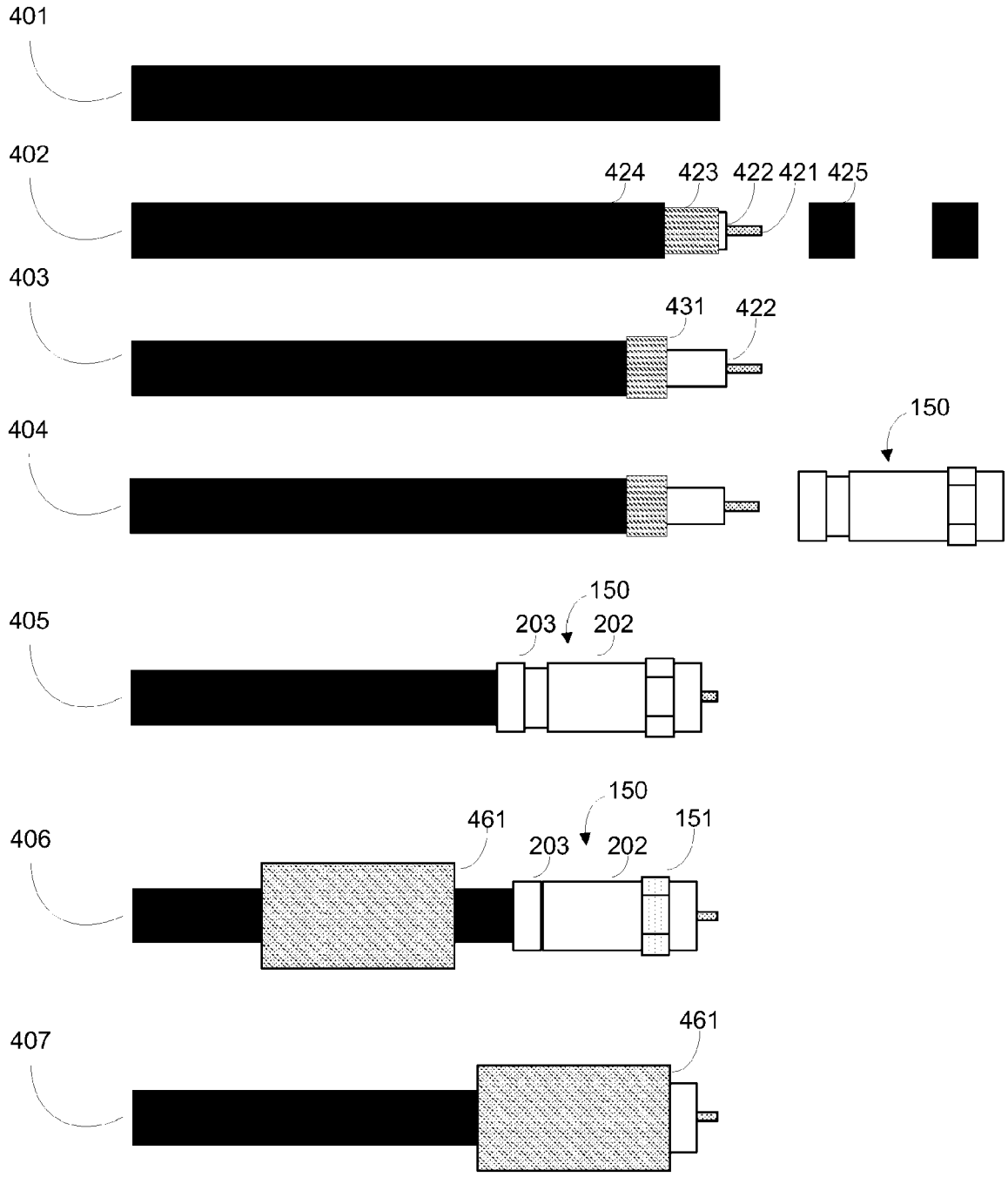
FIG. 4 illustrates various stages of coupling a coaxial cable nut rotation aid to a coaxial cable in a method of using the invention.

FIG. 4 illustrates the various stages of coupling a coaxial cable rotation aid to a coaxial cable. Coaxial cable 401 is shown with an unprepared left hand end, while the right hand side of coaxial cable 401 is shown in a prepared state having a clean cut end that is perpendicular to the axis along coaxial cable 401. Stripped coaxial cable 402 is shown as stripped with a ¼ inch by ¼ inch stripping tool. As shown, outer insulating jacket 424, shield braiding 423 and dielectric 422 are cut away on the far right, thereby leaving conductor 421 exposed. The stripping tool cuts outer insulating jacket 424 down to shield braiding 423, which is also shown removed as removed outer shield braiding 425. Prepared coaxial cable 403 is shown with shield braiding is shown folded back at 431 away from dielectric 422 in preparation for coupling coaxial connector 150, which is placed in line with correctly aligned and prepared coaxial cable 404. Coaxial connector 150 is seated on fully prepared coaxial cable 405 wherein dielectric 422 is fully pressed into post 201 until it travels no further and in so doing sleeve 203 and collar 202 are in axial alignment and are ready for compression. A crimping tool is utilized to compress coaxial connector 150 to yield fully coupled coaxial cable 406 wherein sleeve 203 and collar 202 are fully engaged, therein fixedly attaching sleeve 203 and collar 202 to the coaxial cable. Coaxial cable connector nut rotation aid 461 is slipped onto the bare end of coaxial cable 406, i.e., from the opposite end of cable 406, aid 461 may then be crimped onto nut 151 thereby producing coaxial connector rotational aid end 407. By preparing and coupling another coaxial connector to the opposing (left side as shown) of end coaxial cable 406, view 407 may be seen. Next, coaxial cable connector nut rotation aid 461 may be crimped onto the opposing nut by sliding coaxial cable connector nut rotation aid 461 off of nut 151 manually and moving coaxial cable connector nut rotation aid to the opposing side. The grooves carved into each side allow for a non-rotational coupling with respect to nut 151 and a rotational coupling with respect to outer insulating jacket 424.

A method for utilizing a coaxial cable connector rotation aid may include aligning a tubular metal element with a first coaxial cable connector nut along a longitudinal axis of a coaxial cable, engaging the tubular metal element with said first coaxial cable connector nut in a non-fixed and non-rotatable manner; disengaging the tubular metal element from the coaxial cable connector nut and, engaging said tubular metal element with a second coaxial cable connector nut non-fixedly and non-rotatably with said second coaxial connector nut. This provides for a fit of the aid that cannot be swallowed by a child or pet since the aid is trapped between the two opposing coaxial cable connector nuts on opposing ends of the cable.

While the invention herein disclosed has been described by means of specific embodiments and applications thereof, numerous modifications and variations could be made thereto by those skilled in the art without departing from the scope of the invention set forth in the claims.

What is claimed is:

1. A coaxial cable connector rotation aid comprising:

a tubular element having a textured area on an outer surface without facets of said tubular element wherein said outer surface comprises a rounded smooth area having a circumference and further comprising a non-slip or rubber strip attached to said aid along the circumference of said rounded smooth area or wherein the textured area of said aid is conical in shape, and wherein said tubular element comprises a
metal,
plastic or
composite;

said tubular element comprising an inner diameter dimension configured to engage a threaded coaxial cable connector fixedly in a longitudinal direction and rotatably with respect to a remainder of said threaded coaxial cable connector wherein said tubular element is rotatably coupled with respect to a coaxial cable fixed with said threaded coaxial cable connector; and, said tubular element configured to fixedly engage said threaded coaxial cable connector in a longitudinal direction and rotatably engage said threaded coaxial cable connector with respect to a remainder of said threaded coaxial cable connector comprising
a coaxial cable connector post and
a coaxial cable connector collar.

2. The coaxial cable connector rotational aid of claim 1 wherein said tubular element comprises radio frequency shielding that provides additional radio frequency shielding for said threaded coaxial cable connector.

3. The coaxial cable connector rotational aid of claim 1 further comprising a smooth portion on said outer surface.

4. A coaxial cable connector nut rotation aid comprising:

a tubular element comprising internal threads having a textured area on an outer surface of said tubular element wherein said tubular element comprises a
metal,
or a composite of metal and plastic;

said tubular element comprising an inner diameter dimension configured to engage a coaxial connector component; and, said tubular element configured to fixedly engage and rotatably attach between
a coaxial cable connector post and
a coaxial cable connector collar.

5. The coaxial cable rotation aid of claim 4 wherein said tubular element is engaged fixedly in said longitudinal direction.

6. The coaxial cable rotation aid of claim 4 further comprising:

a second inner diameter dimension that differs from said inner diameter dimension wherein said tubular element comprises two internal cylinders that comprise said inner diameter dimension and said second inner diameter dimension.

7. The coaxial cable rotation aid of claim 4 further comprising:

a stop positioned inside said tubular element to limit an entry depth of said coaxial connector component.

8. The coaxial cable rotation aid of claim 4 wherein said tubular element comprises shielding that provides additional shielding for said coaxial cable connector collar.

9. A method for utilizing a coaxial cable connector rotation aid comprising:

aligning a tubular element that comprises a
metal,
plastic or
composite of metal and plastic
with a first threaded coaxial cable connector along a longitudinal axis of a coaxial cable;

engaging said tubular element with said first threaded coaxial cable connector in a non-fixed manner in a longitudinal direction and non-rotatable manner with respect to said first threaded coaxial cable connector and in a rotatable manner with respect to said coaxial cable;

disengaging said tubular element from said first threaded coaxial cable connector nut without removing said tubular element from said coaxial cable;

sliding said tubular element along said coaxial cable from said first threaded coaxial cable connector to a second threaded coaxial cable connector; and, engaging said tubular element with said second threaded coaxial cable connector non-fixedly and non-rotatably with said second coaxial connector nut.

10. The method of claim 9 further comprising coupling said first threaded coaxial cable connector and said second threaded coaxial cable connector on opposite ends of said coaxial cable wherein said tubular element is engaged fixedly in a longitudinal direction and non-rotatably with said first threaded coaxial cable connector and wherein a second tubular element is engaged fixedly in a longitudinal direction and non-rotatably with said second threaded coaxial cable connector.

11. The method of claim 9 further comprising creating grooves in said tubular element during said engaging said tubular element through physical contact with said first threaded coaxial cable connector and creating additional grooves in said tubular element during said engaging said tubular element through physical contact with said second threaded coaxial cable connector.

12. The method of claim 9 further comprising providing additional shielding for said coaxial cable connector nut.

13. The method of claim 9 further comprising wherein said tubular element is installed onto said coaxial cable before said second threaded coaxial cable connector is installed and wherein said tubular element has an internal diameter smaller than either of said threaded coaxial cable connector and said second threaded coaxial cable connector.

14. The method of claim 9 whereby said tubular element remains slidingly engaged to said coaxial cable when unengaged from either of said coaxial cable connector nuts or wherein said tubular element remains fixedly engaged with said one or the other of the coaxial cable connector nuts in said longitudinal direction.

* * * * *